US008272717B2

(12) United States Patent
Hoisington et al.

(10) Patent No.: US 8,272,717 B2
(45) Date of Patent: Sep. 25, 2012

(54) JETTING DEVICE WITH REDUCED CROSSTALK

(75) Inventors: Paul A. Hoisington, Hanover, NH (US); Christoph Menzel, New London, NH (US); John A. Higginson, Santa Clara, CA (US); Andreas Bibl, Los Altos, CA (US); Kevin Von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 343 days.

(21) Appl. No.: 12/749,269

(22) Filed: Mar. 29, 2010

(65) Prior Publication Data

US 2011/0234668 A1 Sep. 29, 2011

(51) Int. Cl.
*B41J 2/045* (2006.01)

(52) U.S. Cl. ..... 347/68

(58) Field of Classification Search ..... 347/68
See application file for complete search history.

(56) References Cited

U.S. PATENT DOCUMENTS

| | | | | |
|---|---|---|---|---|
| 6,899,416 | B2 | 5/2005 | Silverbrook | |
| 7,370,944 | B2 * | 5/2008 | Cabal et al. | 347/65 |
| 7,836,600 | B2 * | 11/2010 | Chwalek et al. | 29/890.1 |
| 8,047,632 | B2 * | 11/2011 | Fujii et al. | 347/54 |
| 8,113,630 | B2 * | 2/2012 | Suzuki et al. | 347/68 |
| 2007/0296765 | A9 | 12/2007 | Silverbrook | |

FOREIGN PATENT DOCUMENTS

| | | |
|---|---|---|
| WO | 2009/142894 | 11/2009 |
| WO | 2009/143362 | 11/2009 |

* cited by examiner

*Primary Examiner* — Julian Huffman
(74) *Attorney, Agent, or Firm* — Fish & Richardson P.C.

(57) ABSTRACT

A printing device for jetting a liquid includes a flow path body having a plurality of jetting flow paths, a liquid in the plurality of jetting flow paths, a piezoelectric actuator associated with each jetting flow path, a feed substrate having a plurality of fluid inlets, and a driver configured to apply a voltage pulse to the piezoelectric actuator. The first jetting flow path is adjacent to the second jetting flow path and a fluidic travel distance from the piezoelectric actuator of the first jetting flow path to a nozzle of the second jetting flow path is greater than a speed of sound in the liquid times the break off time of a droplet of the fluid from the nozzle.

20 Claims, 4 Drawing Sheets

JETTING DEVICE WITH REDUCED CROSSTALK

TECHNICAL FIELD

Fluid ejection devices are described.

BACKGROUND

In some liquid ejection devices, liquid droplets are ejected from one or more nozzles onto a medium. The nozzles are fluidically connected to a fluid path that includes a fluid pumping chamber. The fluid pumping chamber can be actuated by an actuator, which causes ejection of a liquid droplet. The medium can be moved relative to the liquid ejection device. The ejection of a liquid droplet from a particular nozzle is timed with the movement of the medium to place a liquid droplet at a desired location on the medium. In these liquid ejection devices, it is usually desirable to eject liquid droplets of uniform size and speed and in the same direction in order to provide uniform deposition of liquid droplets on the medium.

SUMMARY

In one aspect, a printing device for jetting a liquid includes a flow path body having a plurality of jetting flow paths, a liquid in the plurality of jetting flow paths, a piezoelectric actuator associated with each jetting flow path, a feed substrate having a plurality of fluid inlets, wherein the piezoelectric actuator associated with the jetting flow path is between the flow path body and the feed substrate, and a driver configured to apply a voltage pulse to the piezoelectric actuator, the voltage pulse resulting in a break off time for the liquid exiting the nozzle. The plurality of jetting flow paths includes a first jetting flow path and a second jetting flow path, each jetting flow path has a nozzle fluidically connected to a pumping chamber and the pumping chamber is fluidically connected to a fluid flow channel. The pumping chamber is adjacent the piezoelectric actuator. A first fluid flow channel of the first jetting flow path is fluidically connected to a first fluid inlet of the plurality of fluid inlets and a second fluid flow channel of the second jetting flow path is fluidically connected to a second fluid inlet of the plurality of fluid inlets. The first jetting flow path is adjacent to the second jetting flow path and a fluidic travel distance from the piezoelectric actuator of the first jetting flow path to the nozzle of the second jetting flow path is greater than a speed of sound in the liquid times the break off time of a droplet of the fluid from the nozzle.

Implementations can include one or more of the following features. The distance may be at least 1 mm. The speed of sound in the liquid may be between 1000 and 1600 m/s. The break off time of the droplet may be between 1 and 200 microseconds. The nozzle diameter may be between 1 and 100 microns in diameter. The pumping chambers may each have a length extending from a region adjacent to the piezoelectric actuator to the nozzle, the fluid inlets may each have a long axis, and the long axis and the length of each pumping chamber are parallel to one another. Each jetting flow path may be configured to eject the droplet to have a size of between 0.01 and 100 picoliters. The flow path body may include nozzles in an array of columns and rows. Adjacent nozzles in the array may be separated by less than 1 mm, e.g., by less than 500 microns. The feed substrate in which the fluid inlets and outlets are formed may be at least 2 mm thick, e.g., at least 5 mm thick. At least 80% of the path length from the piezoelectric actuator of the first jetting flow path to the nozzle of the second jetting flow path may be through the feed substrate. The flow path body may have an outer surface having nozzles of the jetting flow paths, and a plurality of fluid inlets in the feed substrate may extend perpendicular to the outer surface. The flow path body may have an outer surface having nozzles of the jetting flow paths, and at least 80% of the path length from the piezoelectric actuator of the first jetting flow path to the nozzle of the second jetting flow path may be perpendicular to the outer surface. The driver may be configured to apply a sequence of fire pulses, and a spacing between pulses may be at least twice the width of the fire pulses.

In another aspect, a method of assembling a printing device includes selecting a voltage pulse to apply from a driver to a piezoelectric actuator in the printing device, determining a break off time for the liquid exiting the nozzle resulting from the voltage pulse, selecting a liquid for ejection from the printing device, calculating a speed of sound in the liquid times the break off time of a droplet of the liquid, connecting a flow path body to a feed substrate, the flow path body comprising a first jetting flow path and an adjacent second jetting flow path, each jetting flow path having a nozzle fluidically connected to a pumping chamber actuated by a piezoelectric actuator, the feed substrate having a first fluid inlet connected to the first flow path and a second fluid fluid inlet connected to the second flow path, and selecting a thickness of the feed substrate such that a fluidic travel distance from the piezoelectric actuator of the first jetting flow path to the nozzle of the second jetting flow path is greater than a speed of sound in the fluid times the break off time of a droplet of the fluid from the nozzle.

In another aspect, a method of assembling a printing device includes forming a plurality of jetting flow paths in a flow path body, the plurality of jetting flow paths including a first jetting flow path and a second jetting flow path, the first jetting flow path being adjacent to the second jetting flow path, each jetting flow path having a nozzle fluidically connected to a pumping chamber and the pumping chamber is fluidically connected to a fluid flow channel, forming a piezoelectric actuator adjacent each pumping chamber, forming a plurality of fluid inlets in a feed substrate, the plurality of fluid inlets including a first fluid inlet and a second fluid inlet, securing the feed substrate to the flow path body such that the first fluid inlet is connected to the first flow path and the second fluid inlet is connected to the second flow path, and connecting a driver configured to apply a voltage pulse to the piezoelectric actuators, the voltage pulse resulting in a break off time for a liquid exiting the nozzle. A fluidic travel distance from the piezoelectric actuator of the first jetting flow path to the nozzle of the second jetting flow path is greater than a speed of sound in the liquid times the break off time of a droplet of the fluid from the nozzle.

Implementations can include one or more of the following features. Adjacent nozzles in the flow path body may be separated by less than 1 mm. The feed substrate in which the fluid inlets and outlet are formed may be greater than 2 mm thick.

Advantages of the devices described herein may include one or more of the following. Fluidic cross-talk between adjacent jetting flow paths can be reduced or eliminated using the structural arrangement described. Reducing or eliminating fluidic cross-talk can improve drop ejection uniformity and accuracy. Improved drop ejection uniformity and accuracy can lead to more accurate representations of the image to be printed.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

During liquid droplet ejection, when an actuator located above pumping chambers is activated, a pressure wave propagates through the pumping chamber toward a nozzle. Some of the energy from the pressure wave can propagate into a fluid inlet passage that is fluidly connected to the pumping chamber. Likewise, some of the energy can propagate through a fluid outlet passage. In some jetting devices, the fluid inlet passage is fluidically connected to a fluid supply and the fluid outlet is fluidically connected to a fluid return. Adjacent jetting flow paths are also fluidly connected to the fluid supply. The energy propagation can cause pressure waves in the fluid inlet passage from one jetting flow path to enter the fluid inlet or outlet passage of adjacent jetting flow paths though the fluid supply or return. This transference of energy can cause fluidic cross-talk between neighboring jetting flow paths, which can adversely affect fluid droplet ejection performance. The fluid ejection performance can be controlled by altering the configuration of the printhead in such a way that optimizes the distance between the actuator of one jetting flow path to a nozzle of a neighboring jetting flow path.

Fluid droplet ejection can be implemented with a substrate that includes a flow path body, a membrane, and a nozzle layer. The flow path body has a flow path or jetting flow path formed therein, the jetting flow path can include fluid flow channels and a fluid pumping chamber. In some implementations, the fluid flow path includes an ascender and descender as well as or instead of fluid flow channels. The flow path can be microfabricated. An actuator can be located on a surface of the membrane opposite the flow path body and proximate to the fluid pumping chamber. When the actuator is actuated, the actuator imparts a firing pulse to the pumping chamber to cause ejection of a droplet of fluid through the nozzle. Frequently, the flow path body includes multiple flow paths and nozzles.

A fluid droplet ejection system can include the flow path body described. The system can also include a source of fluid for the substrate as well as a return for fluid that is flowed through the flow path body but is not ejected out of the nozzles of the flow path body. A fluid reservoir can be fluidically connected to the flow path body for supplying fluid, such as ink, to the flow path body for ejection. Fluid flowing from the flow path body can be directed to a fluid return tank. The fluid can be, for example, a chemical compound, a biological substance, or ink.

Figure 1:
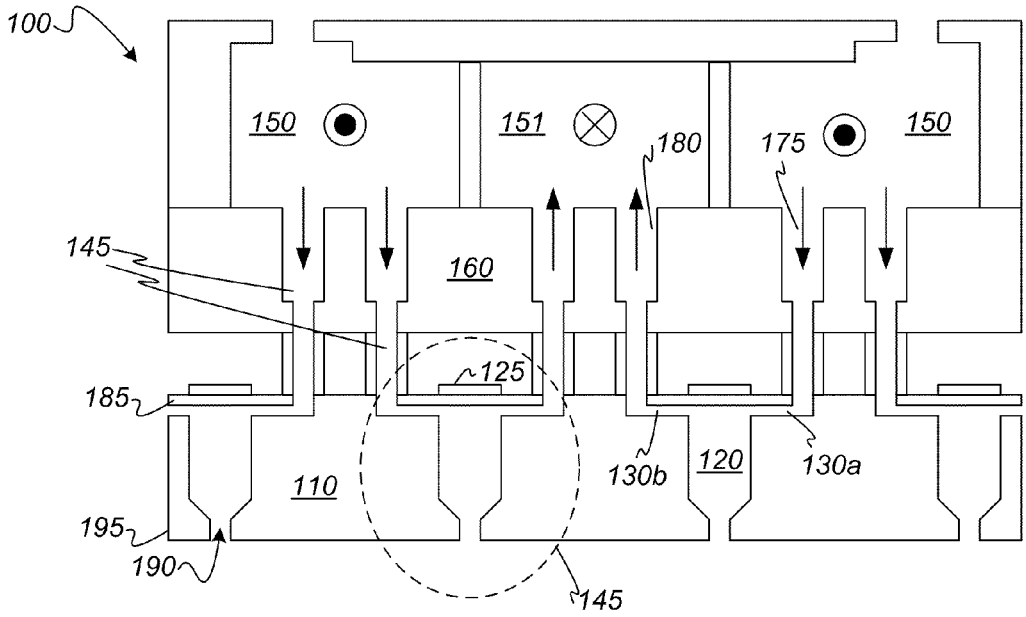
FIG. 1 is a schematic cross sectional view of a part of a liquid ejection device in a quiescent state.

Referring to FIG. 1, one implementation of a printhead 100 is shown for ejecting fluid. The printhead 100 includes a flow path body 110 in which a pumping chamber 120 is formed. One or two fluid flow channels are fluidly connected to the pumping chamber 120. A single fluid flow channel 130*a* can provide fluid to the pumping chamber 120 from a fluid supply 150. A second fluid flow channel 130*b* can allow fluid to move from the pumping chamber 120 to the fluid return 151. A feed substrate 160 is located above the flow path body 110, between the liquid supply 150 and the flow path body 110. A fluid inlet 175 in feed substrate 160 is fluidically connected to a fluid flow channel 130*a* and provides a fluid path between the pumping chamber 120 and the fluid supply 150. Optionally, a fluid outlet 180 in feed substrate 160 is fluidically connected to a fluid flow channel 130*b* that also allows liquid to flow from the pumping chamber 120 to the fluid return 151. The fluid supply 150 and fluid return 151 are fluidically connected to a fluid reservoir (not shown). The inlets 175 are connected to a fluid supply 150 while the outlets 180 are connected to a fluid return 151. The inlets 175 and outlets 180 can be passages through the feed substrate 160 that extend perpendicular to the exterior surface 192 in which the nozzles are formed. In some implementations, the fluid supply 150 and fluid return 151 can be passages in a body that run parallel to the exterior surface 192 in which the nozzles are formed. In some implementations, the fluid supply 150 and fluid return 151 can be passages in a body that extend perpendicular to the fluid inlets 175 and fluid outlets 180 in the feed substrate 160. In some implementations, during operation, the fluid in the fluid supply 150 travels in the opposite direction as the fluid in the fluid return 151, e.g., the ports to the fluid supply 150 and fluid return 151 can be located on opposite ends of the body in which the fluid supply and fluid return passages are formed. In some implementations, the feed substrate 160 includes electrical connections, such as for connecting to actuators on the flow path body 110. In some implementations, the feed substrate 160 is an ASIC layer.

A transducer, such as a piezoelectric actuator 125 is adjacent to the pumping chamber 120. The piezoelectric actuator 125 can include a layer of piezoelectric material, such as a layer of lead zirconium titanate (PZT), an electrical trace, and a ground electrode. The electrical trace and ground electrode are not shown for the sake of simplicity. An electrical voltage can be applied between the electrical trace and the ground electrode of the actuator 125 to apply a voltage to the actuator 125 and thereby actuate the actuator 125. A driver (not shown) can apply the electrical voltage to the actuator. The actuator 125 is formed on a membrane layer 185. On an opposite end of the pumping chamber 120 from the actuator 125 is a nozzle 190. Optionally, the nozzle 190 is formed in a nozzle plate 195 that is attached to the flow path body 110. The nozzle 190 has a nozzle outlet in the exterior surface 192 of the nozzle plate 195. The nozzle 190 can be between 1 and 100 microns in diameter. The printhead 100 can include multiple flow paths 145 (which can be considered to include a fluid flow channel 130, and a fluid inlet 175 or fluid outlet 180), such as tens, hundreds or even thousands of flow paths. A subset of the flow paths in a printhead can all be fluidly connected to a single fluid supply 150. A subset of the flow paths in a printhead can all be fluidly connected to a single fluid return 151.

Figure 2:
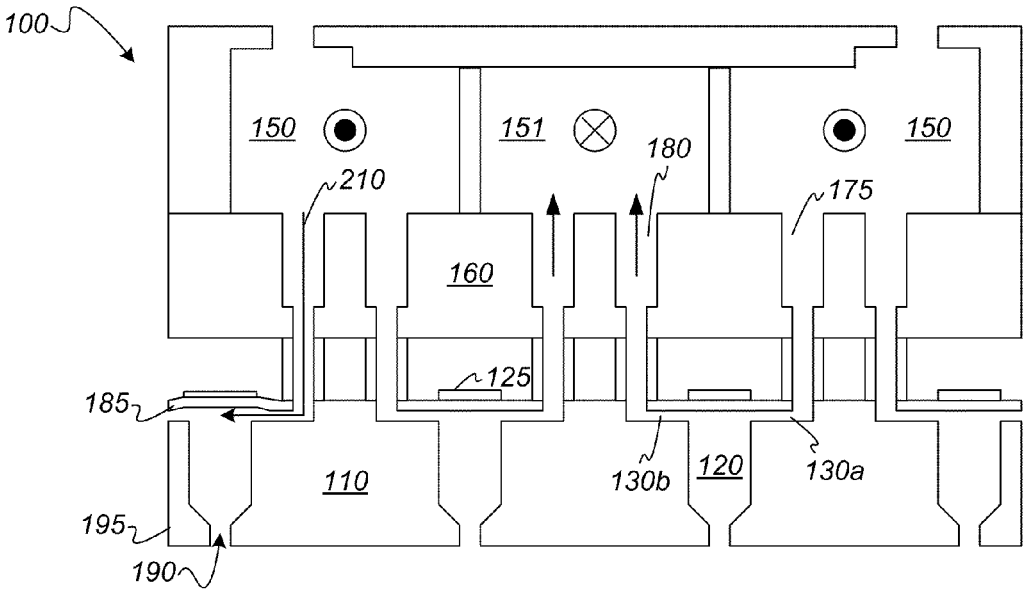
FIG. 2 is a schematic cross sectional view of a part of a liquid ejection device where one jet is in a fill state.

Referring to FIG. 2, the piezoelectric actuator 125 is actuated to fill the pumping chamber 120. Only the actuator on the far left is shown as being actuated. The piezoelectric actuator 125 that is shown includes a layer of piezoelectric material that can be activated to extend or lengthen in a direction that is parallel a main surface of membrane layer 185. Simultaneously, the activation of the piezoelectric material causes the material to become thinner. This lengthening and thinning of the piezoelectric material pulls a portion of the membrane layer 185 toward the piezoelectric actuator 125 and further away from the nozzle. This pulling of the membrane away from the pumping chamber enlarges the pumping chamber 120, which in turn pulls liquid from fluid supply 150 into the pumping chamber 120. See arrow 210 for the direction of travel of the liquid.

Figure 3:
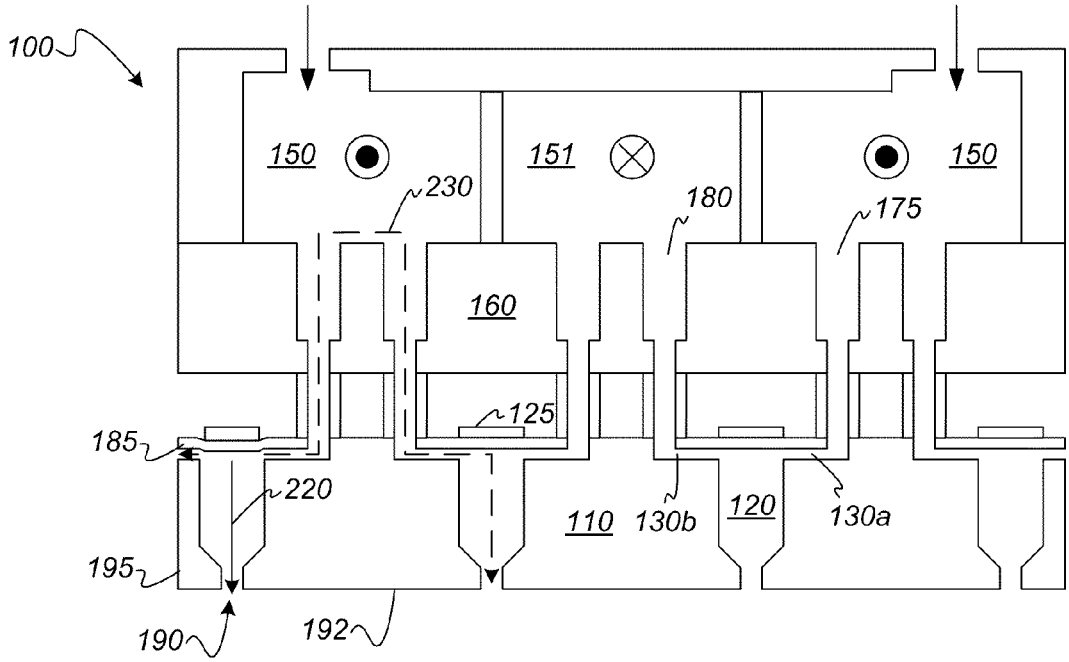
FIG. 3 is a schematic cross sectional view of a part of a liquid ejection device where one jet is in a jetting state.

The next step of actuating the actuator is shown in FIG. 3. Again, only the actuator on the far left is shown as being actuated. Here, the bias is applied across the piezoelectric material to cause the material to shorten and thicken. This pushes a portion of the membrane layer into the pumping chamber 120. As the membrane is pushed into the pumping chamber 120, liquid is forced out of nozzle 190. Alternatively, after lengthening the actuator, the actuator can return to a resting position, which will also force liquid out of the nozzle 190. See arrow 220 for the direction of travel of the pressure wave and liquid.

The liquid that flows out of nozzle 190 of the pumping chamber 120 in the flow path in which the piezoelectric actuator 125 was activated breaks away from liquid in the nozzle 190 at a break off time $t_{bo}$. The break off time $t_{bo}$ can be determined by testing the printhead, but is generally dependent on the nozzle diameter, surface tension, viscosity and density of the liquid. For example, a small nozzle diameter, low viscosity, low density and high surface tension can lead to a relatively short break off time $t_{bo}$. The break off time $t_{bo}$ for a 2 picoliter drop tends to be between 1 and 200 microseconds, such as between 5 and 20 microseconds, e.g., around 5 microseconds. The break off time $t_{bo}$ for a 0.1-1 picoliter drop tends to be between 1 and 200 microseconds, such as between 1 and 20 microseconds, e.g., around 2 microseconds. In some implementations, the droplet size can be between 1 and 10 picoliters.

Simultaneous to the actuator creating the pressure wave that forces liquid out of nozzle 190 in the flow path, the actuator propagates a pressure wave from an edge of the pumping chamber that meets the fluid flow channel 130*a*. The pressure wave travels through the fluid flow channel 130*a* and through a fluid inlet 175. Once the pressure wave meets the fluid supply 150, the pressure wave can then enter any of the fluid inlets that are fluidly connected to the fluid supply 150. The pressure wave has the greatest intensity at the fluid path that is adjacent to the fluid path in which the pressure wave was initiated. The pressure wave movement is shown as arrow 230. Similarly, a pressure wave that travels through the fluid flow channel 130*b* and through a fluid outlet 180. Once the pressure wave meets the fluid return 151, the pressure wave can then enter any of the fluid outlets that are fluidly connected to the fluid return 151.

The pressure wave that enters the adjacent flow path can cause fluidic cross-talk. However, this cross-talk can be mitigated if there is a sufficiently long path length between the flow paths. In particular, if the fluidic travel distance from the edge of the pumping chamber or the edge of the region of a first flow path where the pressure wave propagates initiates to the nozzle of a second flow path is sufficiently long, the cross-talk can be mitigated. In particular, the path length L is from the actuator of a first jet to the outlet of the nozzle of a second jet. The first and second flow paths can be adjacent flow paths or can be further away from one another than adjacent flow paths. So long as the length L is greater than the speed of sound c in the liquid times the break off time $t_{bo}$, cross-talk can be reduced so that it does not adversely affect jetting. Thus, $$L > c * t_{bo} \quad \text{(eq. 1)}$$

For this formula the breakoff time $t_{bo}$ is defined as the time from the start of the fire pulse to the time the drop detaches. Assuming that $t_{bo}$ is 5 microseconds and the speed of sound in the liquid is 1400 m/s, then the maximum distance the pressure wave can propagate in this time is 7 mm. Liquids typically have a speed of sound of about 1000-1600 m/s. Therefore, if the speed of sound in the liquid 1000 m/s and the break off time is 1 microsecond, L is at least 1 mm. If the speed of sound in the liquid is 1400 m/s and the break off time is 2 microseconds, L is at least 2.8 mm. In some implementations, each pair of jetting flow paths within a flow path body have the length L that is greater than the speed of sound in the liquid times the break off time.

Figure 4:
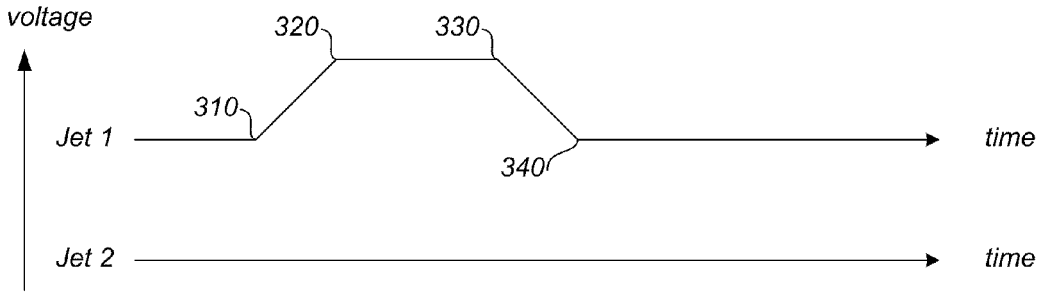
FIG. 4 is a graphical representation of a firing pulse, e.g., voltage as a function of time, at each of two adjacent jets.

Referring to FIG. 4, an exemplary fire pulse is shown. This fire pulse can cause the piezoelectric actuator to deform from its original shape shown in FIG. 1, to the shape shown in FIG. 2, and then back to FIG. 1. A first flow path or first jet is actuated to force liquid out of its nozzle. A second flow path or second jet is not actuated, because no liquid is to be ejected out of its nozzle. Between times 310 and 320, the actuator of the first jet draws liquid into the pumping chamber. Between times 330 and 340, the actuator expels liquid out of the pumping chamber and nozzle. Simultaneously, there is no actuation of the actuator of the second jet.

Figure 5:
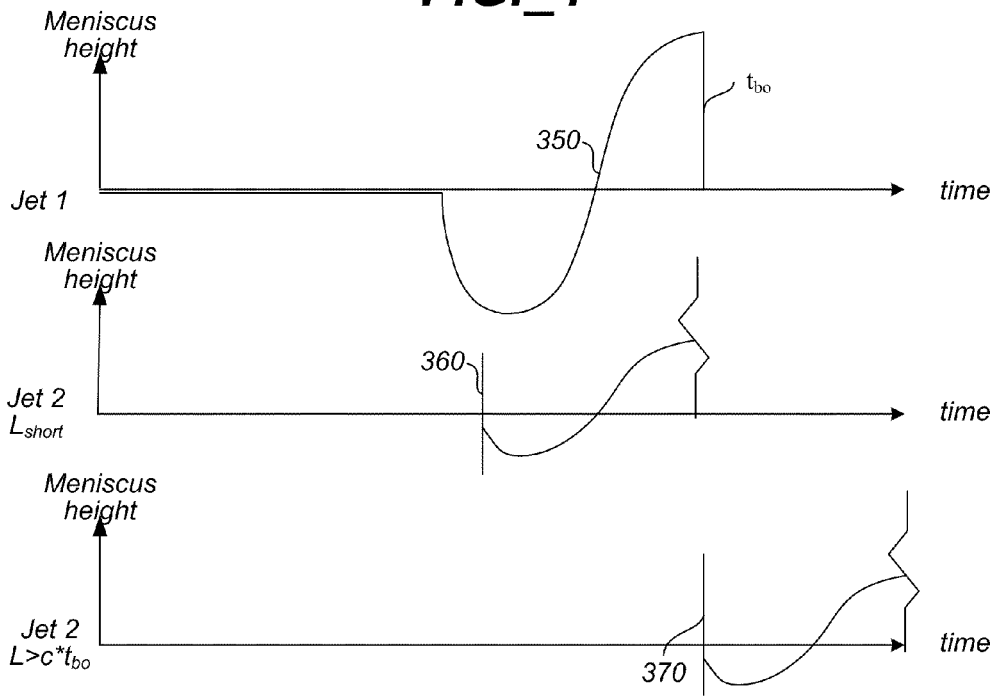
FIG. 5 is a graphical representation of a meniscus height at two adjacent jets.

Referring to FIG. 5, the effect of the fire pulse on the meniscus of the liquid in the jets is shown. In the first jet, the meniscus is drawn in somewhat as the pumping chamber fills. FIGS. 4 and 5 are aligned so that after the filling portion of the fire pulse, the meniscus begins to be drawn inward. The inward direction of the meniscus is shown as below the horizontal time line. After the fire pulse changes to cause ejection, the meniscus then extends out of the nozzle, which is shown as the meniscus curve extending above the horizontal time line. At the break off time $t_{bo}$, the meniscus returns to being close to the nozzle.

Figure 6:
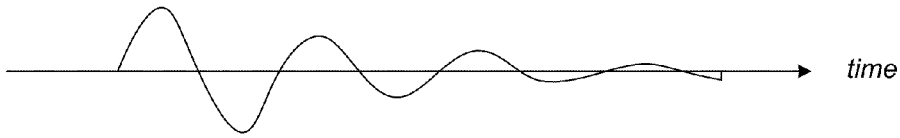
FIG. 6 is a graphical representation of a pressure wave intensity over time.

If the path length L is too short, that is if the path length is not greater than $c*t_{bo}$, then the meniscus in the second jet will begin to extend out of the jet prior to the break off time $t_{bo}$ at the first jet. This is shown by the curve starting at time 360. However, if the path length is greater than $c*t_{bo}$, then fluidic cross-talk is not induced on the same fire pulse. This is shown by the curve starting at time 370. In this later case, while there could be some cross-talk on subsequent pulses, much more time will have elapsed and the pressure wave will have dissipated significantly, as shown in FIG. 6. Thus, there will be less effect on the meniscus of neighboring jets. At the maximum firing rate, the spacing between pulses is at least twice the fire pulse width, e.g., 3 to 5 times the fire pulse width. Because the residual pressure waves damp out in this time frame the crosstalk is greatly reduced. Further, because multiple actuators in the printhead are likely being fired at different times, the cross-talk can be mitigated when competing pressure waves interfere with one another.

In some implementations, the length L of the flow path is increased between jets by causing at least half of the length to be along a path that is parallel to the direction of liquid ejection out of the jet. When jets are very densely packed together, such as when the jets are in a two dimensional array or a matrix of jets where each jet nozzle is less than 1 mm, e.g., less than 500 microns away, e.g., less than 200 microns away, e.g., less than 100 microns away, from an adjacent jet nozzle, the length of the fluid path is dominated by fluid inlet and outlet length. In some implementations, the feed substrate in which the fluid inlets and outlet are formed is greater than 700 microns thick. In some implementations, the feed substrate directly abuts the flow path body 110 and the body in which the fluid supply passages 150 and fluid return passages 151 are formed. Optionally, the spacing between adjacent nozzles can be greater than 40 microns.

Figure 7:
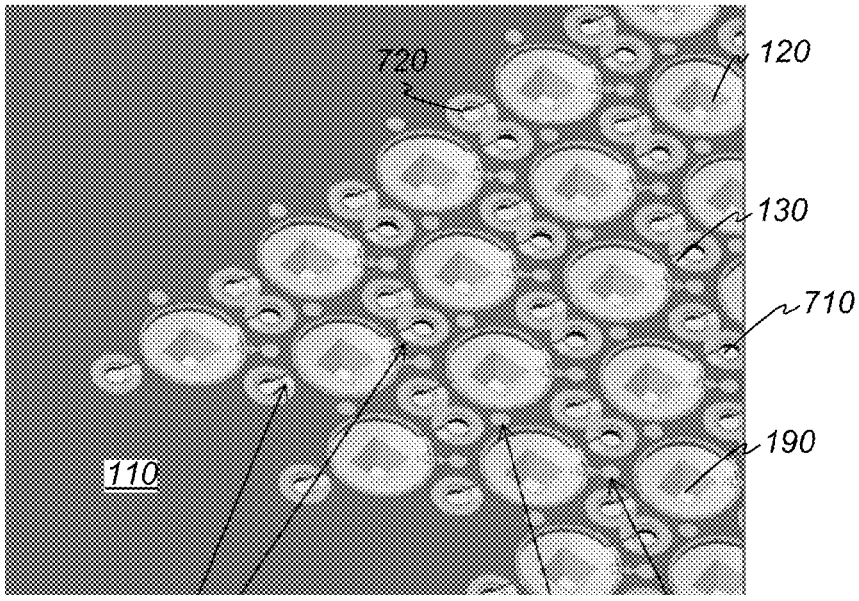
FIG. 7 is a plan view of the fluid body without the membrane layer.

Referring to FIG. 7, a flow path body 110 is shown with pumping chambers 120 and nozzles 190. The pumping chamber 120 is fed through channels 130, which are connected to inlets 710 or outlets 720. The pumping chambers 120 and nozzles 190 are arranged in an array of columns and rows.

Figure 8:
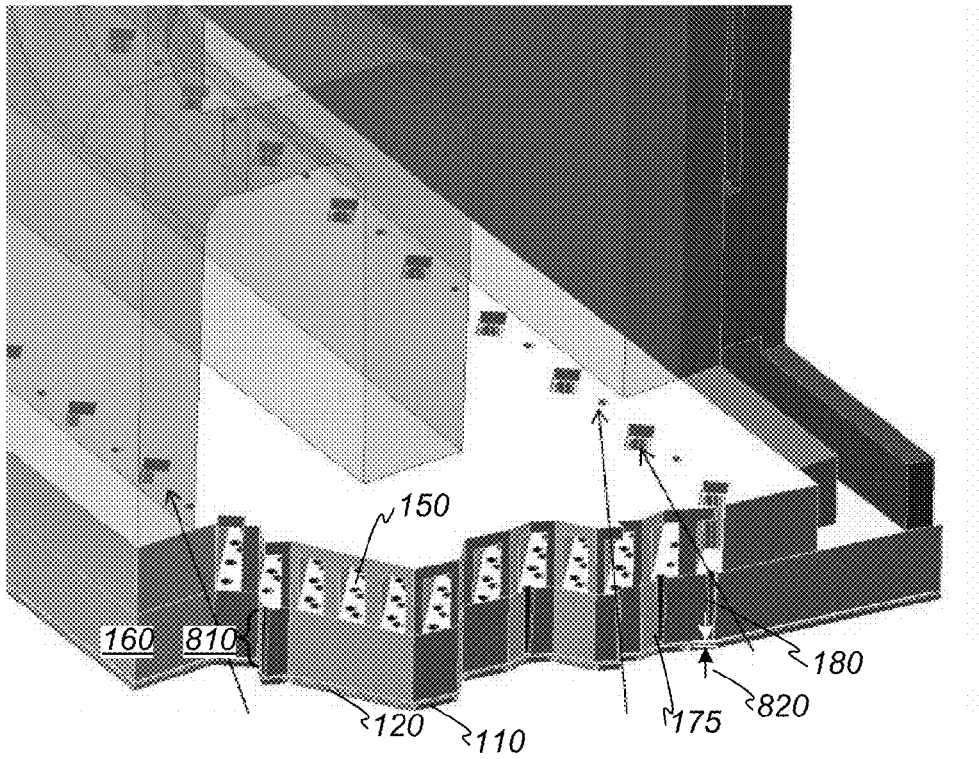
FIG. 8 is a cross-section of a perspective view of a printhead.

Referring to FIG. 8, the flow path body 110 is shown connected to the feed substrate 160 having the fluid inlets 175 and fluid outlets 180 therein. The fluid flow channel 130 length in the flow path body is much less than a length 810 of the fluid inlet 175 in the feed substrate 160. The pumping chamber length 820 is parallel to the fluid inlet and fluid outlet length. As shown, the path length L is at least two times the thickness of feed substrate 160, where the thickness of the feed substrate 160 is in a direction parallel with the droplet ejection direction from the nozzle. Thus, the thickness of the feed substrate 160 can be selected to ensure that the equation $L>c*t_{bo}$ is met to minimize cross-talk. Alternatively, or in addition, the jetting flow paths can be moved further apart from one another. However, this solution can reduce the tight packing of the nozzles and therefore reduce the droplets per inch that the printhead is capable of printing. Thus, to maintain a packing of a linear array of nozzles that is at least 90 dpi or 4 nozzles per mm, in combination with the described flow path structure, the thickness of the feed substrate 160 can be at least 2 mm thick, such as at least 5 mm thick, such as at least 6 mm or 7 mm thick.

A number of implementations of the invention have been described. Nevertheless, it will be understood that various modifications may be made without departing from the spirit and scope of the invention. For example, as described herein, the path length L extends between a portion of a first flow path that is adjacent to its piezoelectric actuator past a portion of the second flow path that is adjacent to the piezoelectric actuator of a second flow path and ends at the nozzle of the second flow path. At least 80% of the path length L, such as more than 90% of the path length or greater than 95% of the path length, can be in the oriented in the same direction, such as vertical or perpendicular to a main surface of the nozzle plate or a main surface of the membrane that covers the pumping chamber. Because the feed substrate can be made with nearly arbitrary thickness, it is possible to increase the path length L by using a thicker feed substrate. At least 80% of the path length L, such as more than 90% of the path length or greater than 95% of the path length, can be through the fluid inlets and fluid outlets in the feed substrate. Accordingly, other implementations are within the scope of the following claims.

What is claimed is:

1. A printing device for jetting a liquid, comprising:

a flow path body comprising a plurality of jetting flow paths, wherein the plurality of jetting flow paths includes a first jetting flow path and a second jetting flow path, each jetting flow path has a nozzle fluidically connected to a pumping chamber and the pumping chamber is fluidically connected to a fluid flow channel;

a liquid in the plurality of jetting flow paths;

a piezoelectric actuator associated with each jetting flow path, wherein the pumping chamber is adjacent to the piezoelectric actuator; and a feed substrate having a plurality of fluid inlets, wherein the piezoelectric actuator associated with the jetting flow path is between the flow path body and the feed substrate; and a driver configured to apply a voltage pulse to the piezoelectric actuator, the voltage pulse resulting in a break off time for the liquid exiting the nozzle, wherein:

a first fluid flow channel of the first jetting flow path is fluidically connected to a first fluid inlet of the plurality of fluid inlets and a second fluid flow channel of the second jetting flow path is fluidically connected to a second fluid inlet of the plurality of fluid inlets, wherein the first jetting flow path is adjacent to the second jetting flow path and a fluidic travel distance (in mm) from the piezoelectric actuator of the first jetting flow path to the nozzle of the second jetting flow path is greater than a speed of sound (in m/s) in the liquid times the break off time (in microseconds) of a droplet of the fluid from the nozzle.

2. The printing device of claim 1, wherein the distance is at least 1 mm.

3. The printing device of claim 1, wherein the speed of sound in the liquid is between 1000 and 1600 m/s.

4. The printing device of claim 3, wherein the break off time of the droplet is between 1 and 200 microseconds.

5. The printing device of claim 1, wherein a diameter of the nozzle is between 1 and 100 microns in diameter.

6. The printing device of claim 1, wherein the pumping chambers each have a length extending from a region adjacent to the piezoelectric actuator to the nozzle and the fluid inlets each have a long axis, wherein the long axis and the length of each pumping chamber are parallel to one another.

7. The printing device of claim 1, wherein each jetting flow path is configured to eject the droplet to have a size of between 0.01 and 100 picoliters.

8. The printing device of claim 1, wherein the flow path body includes nozzles in an array of columns and rows.

9. The printing device of claim 8, wherein adjacent nozzles in the array are separated by less than 1 mm.

10. The printing device of claim 9, wherein adjacent nozzles in the array are separated by less than 500 microns.

11. The printing device of claim 9, wherein the feed substrate is at least 2 mm thick.

12. The printing device of claim 11, wherein the feed substrate is at least 5 mm thick.

13. The printing device of claim 1, wherein at least 80% of the travel distance from the piezoelectric actuator of the first jetting flow path to the nozzle of the second jetting flow path is through the feed substrate.

14. The printing device of claim 1, wherein the flow path body has an outer surface having nozzles of the jetting flow paths, and wherein the plurality of fluid inlets in the feed substrate extend perpendicular to the outer surface.

15. The printing device of claim 1, wherein the flow path body has an outer surface having nozzles of the jetting flow paths, and at least 80% of the travel distance from the piezoelectric actuator of the first jetting flow path to the nozzle of the second jetting flow path is perpendicular to the outer surface.

16. The printing device of claim 1, wherein the driver is configured to apply a sequence of fire pulses, and a spacing between the fire pulses is at least twice the width of the fire pulses.

17. A method of assembling a printing device, comprising:

selecting a voltage pulse to apply from a driver to a piezoelectric actuator in the printing device;

determining a break off time for the liquid exiting the nozzle resulting from the voltage pulse;

selecting a liquid for ejection from the printing device;

calculating a speed of sound in the liquid times the break off time of a droplet of the liquid;

connecting a flow path body to a feed substrate, the flow path body comprising a first jetting flow path and an adjacent second jetting flow path, each jetting flow path having a nozzle fluidically connected to a pumping chamber actuated by a piezoelectric actuator, the feed substrate having a first fluid inlet connected to the first flow path and a second fluid inlet connected to the second flow path; and selecting a thickness of the feed substrate such that a fluidic travel distance (in mm) from the piezoelectric actuator of the first jetting flow path to the nozzle of the second jetting flow path is greater than a speed of sound (in m/s) in the fluid times the break off time (in microseconds) of a droplet of the fluid from the nozzle.

18. A method of assembling a printing device, comprising:

forming a plurality of jetting flow paths in a flow path body, wherein the plurality of jetting flow paths includes a first jetting flow path and a second jetting flow path, the first jetting flow path being adjacent to the second jetting flow path, each jetting flow path has a nozzle fluidically connected to a pumping chamber and the pumping chamber is fluidically connected to a fluid flow channel; forming a piezoelectric actuator adjacent each pumping chamber;

forming a plurality of fluid inlets in a feed substrate, the plurality of fluid inlets including a first fluid inlet and a second fluid inlet;

securing the feed substrate to the flow path body such that the first fluid inlet is connected to the first flow path and the second fluid inlet is connected to the second flow path; and connecting a driver configured to apply a voltage pulse to the piezoelectric actuators, the voltage pulse resulting in a break off time for a liquid exiting the nozzle, wherein a fluidic travel distance (in mm) from the piezoelectric actuator of the first jetting flow path to the nozzle of the second jetting flow path is greater than a speed of sound (in m/s) in the liquid times the break off time (in microseconds) of a droplet of the fluid from the nozzle.

19. The method of claim 18, wherein adjacent nozzles in the flow path body are separated by less than 1 mm.

20. The method of claim 19, wherein the feed substrate in which the fluid inlets and outlet are formed is greater than 2 mm thick.

* * * * *

UNITED STATES PATENT AND TRADEMARK OFFICE

CERTIFICATE OF CORRECTION

PATENT NO. : 8,272,717 B2
APPLICATION NO. : 12/749269
DATED : September 25, 2012
INVENTOR(S) : Paul A. Hoisington et al.

It is certified that error appears in the above-identified patent and that said Letters Patent is hereby corrected as shown below:

Column 10:

In Claim 18, line 4, after "adjacent" insert -- to --.

In Claim 20, line 24, change "outlet" to -- outlets --.

Signed and Sealed this
Fourth Day of December, 2012

David J. Kappos
*Director of the United States Patent and Trademark Office*